United States Patent [19]

Choi

[11] 4,177,602

[45] Dec. 11, 1979

[54] AUTOMATED MECHANISM FOR IMPARTING MOVEMENT TO LIMBS OF A MECHANICAL TOY

[76] Inventor: Eun S. Choi, 315-503, Jamsil-3-dong, Gangnam-ku, Seoul, Rep. of Korea

[21] Appl. No.: 928,285

[22] Filed: Jul. 26, 1978

[51] Int. Cl.[2] ..... A63H 11/00

[52] U.S. Cl. ..... 46/150

[58] Field of Search ..... 46/102, 105, 110, 149, 46/150, 266

[56] References Cited

U.S. PATENT DOCUMENTS

| | | | |
|---|---|---|---|
| 1,422,436 | 7/1922 | Gorgellino | 46/150 |
| 1,649,910 | 11/1927 | Mik | 46/149 |
| 2,667,719 | 2/1954 | Edwardson | 46/150 |
| 2,850,839 | 9/1958 | Bogart | 46/150 |

*Primary Examiner*—Charles E. Phillips
*Attorney, Agent, or Firm*—Finnegan, Henderson, Farabow & Garrett

[57] ABSTRACT

An automated mechanism for imparting life-like movement to limbs of a mechanical toy. The mechanism has at least a pair of limbs which are moved by a connecting rod and cam. Each limb has a first member pivotally mounted at its one end to a gearbox and the other end to an opposing end of a second member to form joints therebetween and axes of rotation. The connecting rod has its one end pivotally connected to the cam and the other end to the second limb member at a distance from the joint formed between the two members. The cam is connected to a motor through a gear mechanism. Two fulcrum pins are mounted at the end of each first limb member adjacent the gearbox to form a space therebetween with the connecting rod being positioned for movement within that space. The pins act as fulcrums for the rod to transfer a predetermined movement to the second limb member when the rod engages the pins. The rotation of the cam means and the movement of the connecting rod give an oscillation motion for the first and second members about their respective axes of rotation and translational motion of the axis of rotation of the second member to simulate a life-like movement to the limbs.

7 Claims, 5 Drawing Figures

AUTOMATED MECHANISM FOR IMPARTING MOVEMENT TO LIMBS OF A MECHANICAL TOY

BACKGROUND OF THE INVENTION

This invention relates to an automated mechanism for a mechanical toy and, more particularly, to an automated mechanism for imparting life-like movement to limbs of a mechanical toy.

Automated mechanisms have been provided for imparting movement to a mechanical toy, such as in walking dolls, moving animals, robots and the like. These mechanisms, however,do not provide a satisfactory movement to the toy limbs, such as the arms, legs, knees, and elbows, which closely simulate life-like movement. In essence, these automated toys have unrealistic and awkward movements during operation.

In addition to the awkward and unrealistic movements imparted by the conventional mechanisms for mechanical toys, these mechanisms are generally not readily adaptable for different toy applications, such as imparting movement to four-limbed mechanical toys as opposed to two-limbed mechanical toys.

There is a need for an automated mechanism which not only imparts life-like movement to limbs of a mechanical toy and which is versatile, but one which also is simple in structure and has an optimum wear life with minimum repair requirements. Conventional automated mechanisms for mechanical toys have not proven completely satisfactory with respect to these criteria.

SUMMARY OF THE INVENTION

Accordingly, it is a primary object of this invention to provide a life-like movement to the limbs of a mechanical toy.

Another object of this invention is to impart the above-described life-like movement to limbs of a mechanical toy in an automated manner.

Yet another object of this invention is to eliminate the above-described problems of conventional automated mechanisms for mechanical toys and to provide an automated mechanism for imparting life-like movement to limbs of a mechanical toy which is versatile, simple in structure, minimizes repair, and maximizes wear life.

Additional objects and advantages of the invention will be set forth in part in the description which follows, and in part will be obvious from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention, as embodied and broadly described herein, the automated mechanism for imparting life-like movement to limbs of a mechanical toy comprises: (1) a motor; (2) a gearbox; (3) cam means rotatably mounted to the gearbox; (4) gear mechanism rotatably mounted to the gearbox and operatively connected to the motor and cam means for rotatably moving the cam means in response to activation of the motor; (5) at least a pair of limbs, each limb having a first member pivotally mounted to form joints at one end to the gearbox and at the other end to an opposing end of a second member; (6) first and second fulcrum pins mounted at the end of each first limb member adjacent the gearbox for forming a space therebetween; (7) a connecting rod for each limb to impart movement thereto in response to rotation of the cam means, the rod having one end pivotally connected to the cam means and the other end to the second member at a distance from the joint formed with the first member, and wherein each rod is positioned for movement within the space formed between the first and second fulcrum pins, the pins acting as fulcrums for the rod to transfer a predetermined movement to the second member when the rod engages the pins.

In a preferred embodiment of the invention, the first fulcrum pins of the limbs comprise a single pin extending through the gearbox for pivotally joining the one ends of the first members to the gearbox and for forming an axis of rotation of the first members. A pin for each limb is further provided for pivotally joining the opposing ends of the first and second members and for forming an axis of rotation of the second member.

In the preferred embodiment of the invention immediately described above, the rotation of the cam means and movement of the connecting rod impart to each limb an oscillational motion of the first and second members about their respective axes of rotation and translational motion of the axis of rotation of the second member.

In one preferred embodiment of the invention, there are a pair of limbs for forming a two-legged toy with the free ends of the second limb members constituting feet and wherein the cam means and connecting rods impart a walking eliptical-orbit type movement to the two legs.

In yet another preferred embodiment of the invention, there are two pairs of limbs for forming a four-legged toy with free ends of the second members constituting feet and wherein the cam means and connecting rods impart a walking type movement to the four legs.

BRIEF DESCRIPTION OF THE DRAWINGS

The accompanying drawings, which are incorporated in and constitute a part of the specification, illustrate an embodiment of the invention and, together with the description, serve to explain the principles of the invention.

DETAILED DESCRIPTION OF THE PREFERRED EMBODIMENT

Reference will now be made in detail to the present preferred embodiment of the invention, an example of which is illustrated in the accompanying drawings. In accordance with the invention, an automated mechanism is provided for imparting life-like movement to limbs of a mechanical toy.

Figure 1:
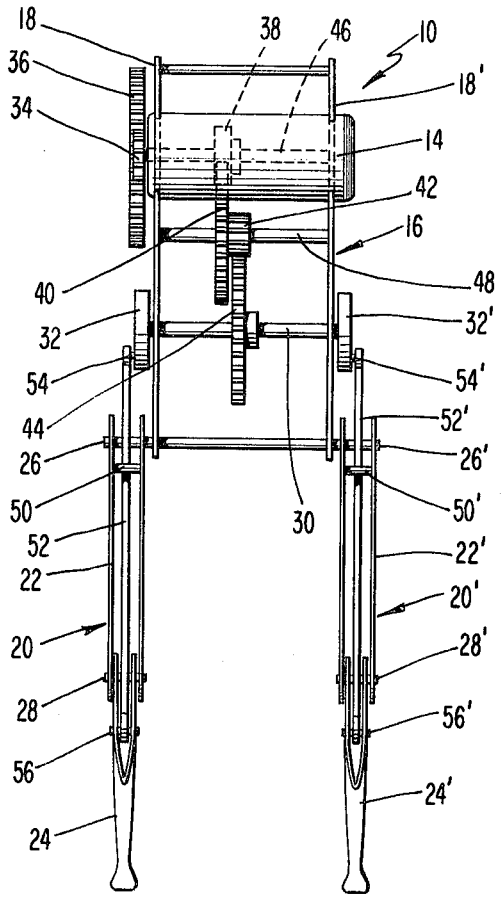
FIG. 1 is an end view of an automated mechanism for a two-legged mechanical toy employing the teachings of this invention.
Figure 2:
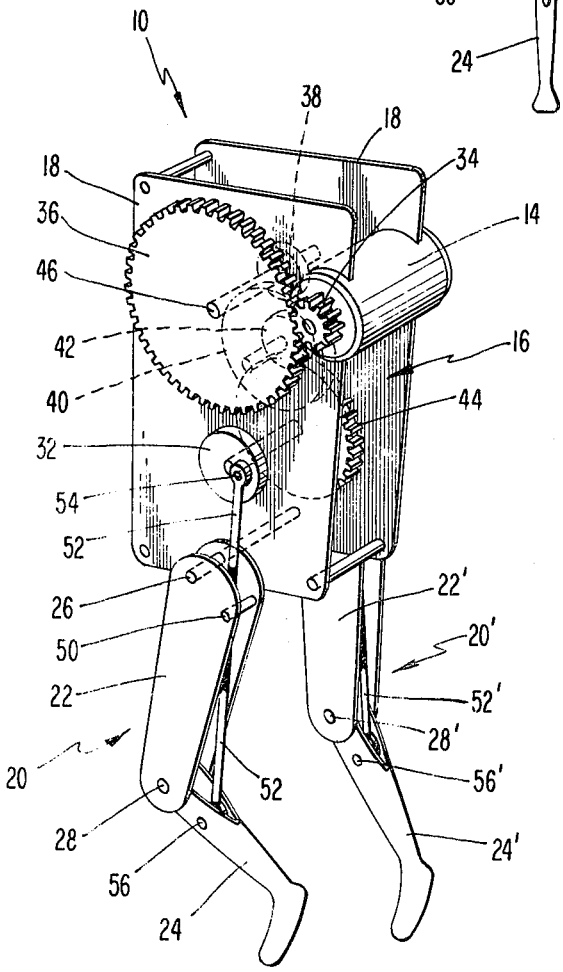
FIG. 2 is a side sectional and perspective view of the automated mechanism of FIG. 1 for a two-legged mechanical toy.
Figure 4:
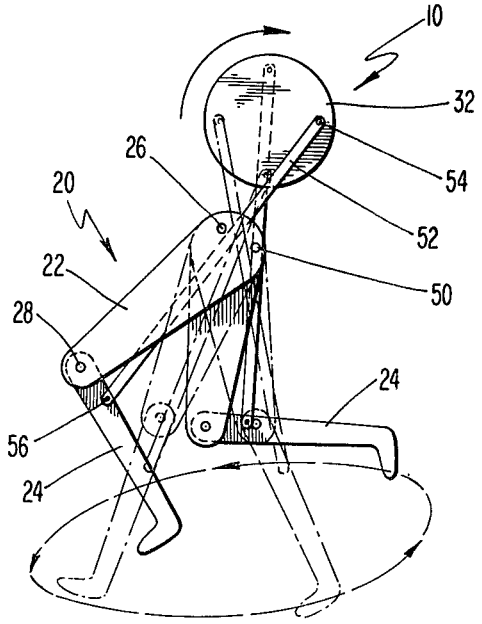
FIG. 4 is a fragmented view of substantially the lower half of the automated mechanism of FIG. 1 for a two-legged mechanical toy and showing the life-like motion imparted to the two leg limbs.
Figure 5:
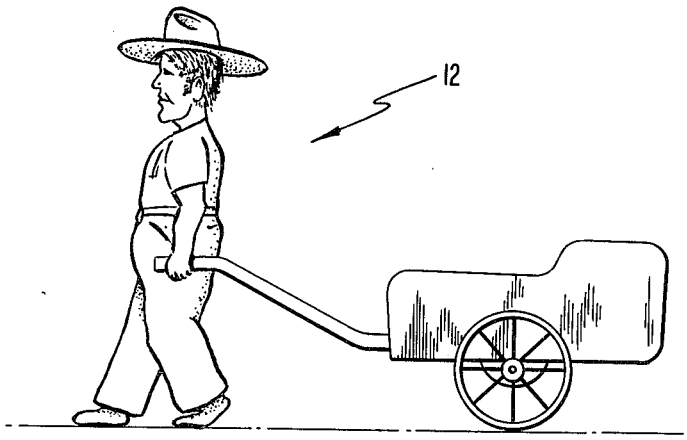
FIG. 5 is a perspective view of an example of a two-legged mechanical toy incorporating the automated mechanism of FIG. 1.

Referring now to FIGS. 1, 2 and 4, there is shown an automated mechanism, generally numbered 10, for imparting life-like movement to limbs of a two-legged mechanical toy 12, such as depicted in FIG. 5. The automated mechanism includes a motor and gearbox. As herein embodied, a motor 14 of miniaturized size is mounted to a substantially rectangular-shaped gear box 16 placed inside the two-legged mechanical toy 12. The motor 14 may be powered by a battery. Preferably, the gearbox 16 has two side plates 18 and 18' fixedly spaced apart by conventional fastening devices for rotatably mounting a gear mechanism inside and outside the gearbox.

In accordance with the invention, the automated mechanism has at least a pair of limbs, each limb having a first limb member pivotally mounted to form joints at one end to the gearbox and at the other end to an opposing end of a second limb member. As here embodied and shown in FIGS. 1–2, and 4–5, the mechanism 10 has a pair of limbs 20 and 20' to form the two legs of the two-legged mechanical toy 12. The limbs 20 and 20' have respective first members 22 and 22' mounted at their one ends to the gearbox 16 and at the other ends to opposing ends of second members 24 and 24'.

Preferably, a single pin has portions 26 and 26' extending through the gearbox 16 for pivotally joining the respective one ends of the first members 22 and 22' to the gearbox 16 and for forming axes of rotation of the first members 22 and 22' around the respective pin portions 26 and 26'. Pins 28 and 28' are provided for pivotally joining opposing ends of the first and second members 22 and 24, and 22' and 24', and for forming axes of rotation of the second members 24 and 24' around the respective pins 28 and 28'.

In accordance with the invention, cam means is rotatably mounted to the gearbox. As here embodied, and best shown in FIGS. 1 and 2, the cam means comprises a single shaft 30 rotatably mounted through the side plates 18 and 18 ' of the gearbox 16. Fixedly attached to the ends of the shaft 30 outside the gearbox 16 are two cams 32 and 32' for transfering movement, upon rotation, to the respective limbs 20 and 20'.

In accordance with the invention, a gear mechanism is rotatably mounted to the gearbox and operatively connected to the motor and cam means for rotatably moving the cam means in response to activation of the motor. As here embodied, and best seen in FIGS. 1 and 2, the gear mechanism of the automated mechanism 10 comprises a series of gears 34, 36, 38, 40, 42, and 44. It is preferred that gear 34 be a small gear connected to a shaft of the motor 14 and positioned outside the gearbox 16 adjacent the side plate 18. The gear 36 is a main gear mounted on a rotatable shaft 46 extending through the gearbox 16. Gear 36 is positioned outside the side plate 18 for meshing with gear 34. The gear 38 is a small gear mounted on the shaft 46 within the gearbox 16 so as to rotate when gears 34 and 36 are rotated. The gears 40 and 42 are mounted between the side plates 18 and 18' on a rotatable shaft 48 extending through the gearbox 16. The gear 44 is mounted to the same shaft 30 as the cams 32 and 32'. The gear 42 is meshed with the gear 44 while gear 40 is meshed with the gear 38. As can thus be seen, the interconnection and meshing of this series of gears of the gear mechanism will rotatably move the cams 32 and 32' in response to activitation of the motor 14.

In accordance with the invention, first and second fulcrum pins are mounted at the end of each first limb member adjacent the gearbox for forming a space therebetween. As here embodied and best seen in FIGS. 1 and 2, the first fulcrum pins of the mechanism 10 comprise the single pin having portions 26 and 26' extending through the gearbox 16 for pivotally joining the ends of the first members 22 and 22' to the gearbox. The second fulcrum pins preferably comprise the pins 50 and 50' which are mounted at the ends of the respective first members 22 and 22' adjacent the pin portions 26 and 26' for forming spaces therebetween.

In accordance with the invention, a connecting rod is provided for each limb to impart movement thereto in response to rotation of the cam means. The rod has one end pivotally connected to the cam means and the other end to the second limb member at a distance from the joint formed with the first limb member. Each rod is positioned for movement within the space formed between the first and second fulcrums pins on the first limb member, the pins acting as fulcrums for the rod to transfer a predetermined movement to the second limb member when the rod engages the pins.

As here embodied and shown in FIGS. 1 and 2, the automated mechanism 10 includes two elongated connecting rods 52 and 52'. Preferably, a pair of pins 54 and 56, and 54' and 56', are provided for the respective connecting rods 52 and 52'. The first pins 54 and 54' of the pair of pins pivotally connect ends of the respective connecting rods 52 and 52' to the respective cams 32 and 32'. The second pins 56 and 56' of the pair of pins pivotally connect the other ends of the respective connecting rods 52 and 52' to the respective second limb members 24 and 24'. It is also preferred that pins 56 and 56' be mounted at the ends of the connecting rods 52 and 52' in proximity to the respective axes of rotation of the second members 24 and 24' formed by the respective pins 28 and 28'. As best seen in FIG. 2, the connecting rods 52 and 52' are positioned for movement in the respective spaces formed between the fulcrum pins 26 and 50, and 26' and 50'.

To operate the automated mechanism 10 for imparting movement to limbs of the two-legged mechanical toy 12, the motor 14 is activated through the battery. Rotation of the motor shaft in turn imparts rotation to the gear 34. Through the series of meshed gears 34 and 36, 38 and 40, and 42 and 44, rotational movement of a predetermined speed is imparted to the cams 32 and 32'. Since the one ends of the connecting rods 52 and 52' are pivotally mounted by pins 54 and 54' to the respective cams 32 and 32', rotation of the cams will impart predetermined movements to the respective connecting rods 52 and 52'. Movement of the connecting rods 52 and 52' will in turn impart movement to the respective second limb members 24 and 24' to which the connecting rods 52 and 52' are pivotally connected by the pins 56 and 56'. During movement of the connecting rods 52 and 52', portions of the connecting rods will engage the fulcrums pins 26 and 26', and 50 and 50', wherein the pins act as fulcrums to impart additional predetermined movement of the rods to the second limb members 24 and 24' when the rods are so engaged.

As illustrated in FIG. 4, when the cam 32 for the two-legged toy 12 is rotated in a clockwise direction, motion of the left foot formed as a lower portion of the second limb member 24 will be in a counter-clockwise direction to obtain a forward motion of the mechanical toy. The rotation of the cams 32 and 32' and the movement of the respective connecting rods 52 and 52' will impart to the limbs or legs 20 and 20' an oscillational motion of the first and second limb members 22 and 24, and 22' and 24', about their respective axes of rotation at pins 26 and 28, and 26' and 28', and translational motion of the respective axes of rotation of the second members 24 and 24' at the pins 28 and 28'. As depicted in FIG. 4, a walking eliptical-orbit type movement can be achieved for the two legs of the toy during operation.

As illustrated in FIG. 5, the mechanism 10 can be used in a two-legged toy, such as the doll 12 with a carriage wherein the doll will walk pulling the carriage during operation. Batteries for activating the motor 14 can be carried inside the carriage and connected to the motor by a wire through the two arms of the doll. The gearbox, the gear mechanism, and the motor can be contained in the molded body of the doll. The forward motion of the doll attributed to the automated mechanism 10 can be balanced by use of the carriage.

Figure 3:
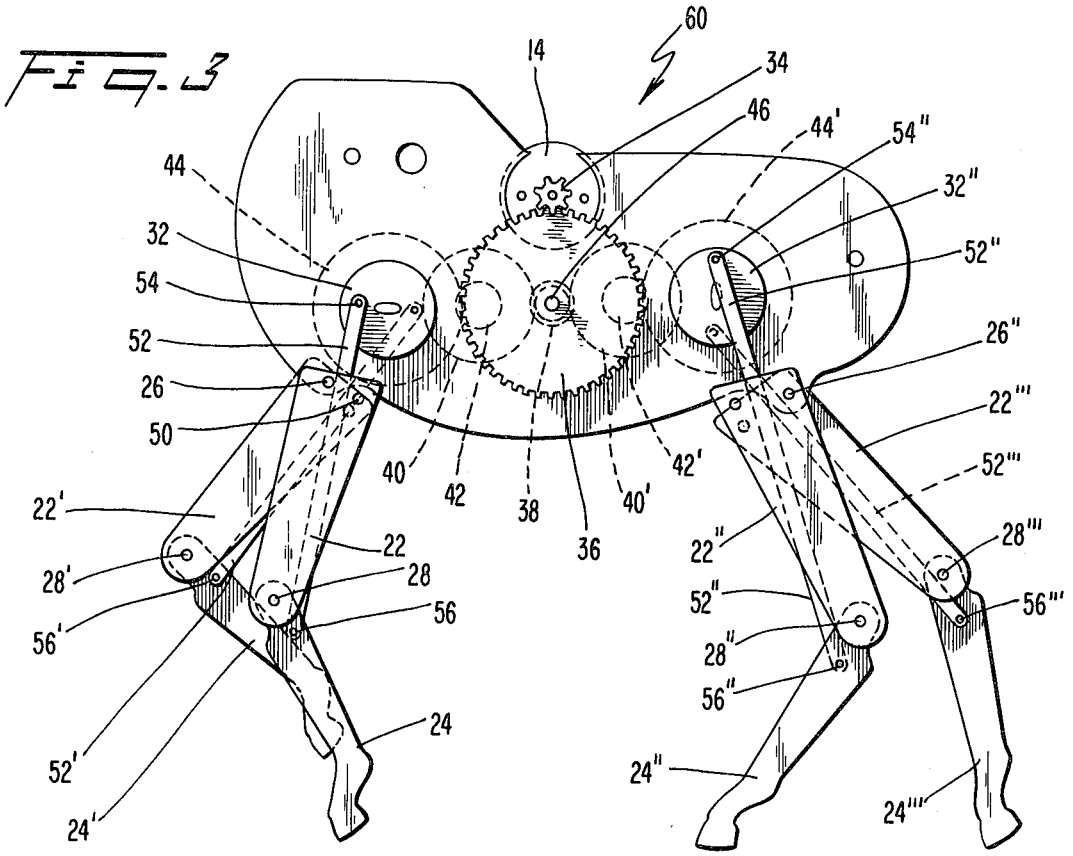
FIG. 3 is a side sectional and perspective view of an automated mechanism for a four-legged mechanical toy employing the teachings of this invention.

Referring now to FIG. 3, there is shown an automated mechanism, generally numbered 60, incorporating the teachings of this invention, for imparting life-like movements to limbs of a four-legged mechanical toy, such as a dog, horse, or like animal.

The automated mechanism 60, as depicted in FIG. 3, has two pairs of limbs for forming the four legs of the toy instead of the one pair of leg limbs as for the mechanism 10. The operation of the mechanism 60 is similar in nature to the mechanism 10, however. Components of mechanism 60 similar to those of mechanism 10 are shown in FIG. 3 with same reference numerals with elements for the second set of legs being identified with additional asterisks. For example, the second pair of limbs are identified as 20" and 20"' with the limb 20" having first member 22", second member 24", connecting rod 52" with pivoting pins 54" and 56", fulcrum pins 26" and 50", joint pin 28", and cam 32".

A single motor 14 is maintained with a single small gear 34 mounted on the motor shaft. A single main gear 36 again meshes with the gear 34 to impart a rotational movement to the shaft 46 on which is mounted the single gear 36. In the mechanism 60 shown in FIG. 3, a corresponding set of gears 40', 42', and 44' are provided for the second pair of limbs 20" and 20"' such that the gear 40' for the second pair of limbs and the gear 40 for the first pair of limbs mesh with a common single gear 38 mounted on shaft 46 to be driven simultaneously by the motor 14. It can thus be seen that during operation of the automated mechanism 60, the motor 14 will rotatably move the four cams to impart predetermined movement through the respective connecting rods 52, 52', 52", and 52"' to the second members 24, 24', 24", and 24"'. In this manner, the rotation of the cam means and movement of the connecting rods will impart a life-like walking type movement to the four leg limbs of the four-legged mechanical toy.

It will be apparent to those skilled in the art that modifications and variations can be made in the automated mechanism of the present invention and in the construction of the mechanical toy without departing from the scope or spirit of the invention. For example, the gear mechanism of this invention could be employed to move cams and connecting rods to limbs in an upper portion of the body of the toy, such as in the arms and elbows, to impart a predetermined movement to those members. Thus, it is intended that the present invention cover the modifications and variations of this invention not specifically described for the preferred embodiment.

What is claimed is:

1. An automated mechanism for imparting life-like movement to limbs of a mechanical toy comprising:
(a) a motor;
(b) a gearbox;
(c) cam means rotatably mounted to the gearbox;
(d) gear mechanism rotatably mounted to the gearbox and operatively connected to the motor and cam means for rotatably moving the cam means in response to activation of the motor;
(e) at least a pair of limbs, each limb having a first member pivotally mounted to form joints at one end to the gearbox and at the other end to an opposing end of a second member;
(f) first and second fulcrum pins mounted at the said one end of each first limb member adjacent the gearbox and forming a space between said fulcrum pins;
(g) a connecting rod for each limb to impart movement thereto in response to rotation of the cam means, the rod having one end pivotally connected to the cam means and the other end to the second member at a distance from the joint formed with the first member, and wherein each rod is positioned for movement within the space formed between the first and second fulcum pins, the pins acting as fulcrums for the rod to transfer a predetermined movement to the second member when the rod engages the pins.

2. The automated mechanism of claim 1 wherein the first fulcrum pins of the limbs comprise a single pin extending through the gearbox for pivotally joining the one ends of the first members to the gearbox and for forming an axis of rotation of the first members, and wherein the mechanism further comprises a pin for each limb for pivotally joining the opposing ends of the first and second members and for forming an axis of rotation of the second member.

3. The automated mechanism of claim 2 further comprising a pair of pins for each connecting rod, one for pivotally connecting the one end of the connecting rod to the cam means and the other for pivotally connecting the other end of the connecting rod to the second member in proximity to the axis of rotation of the second member.

4. The automated mechanism of claim 3 wherein the cam means comprises a cam for each limb connected to the respective connecting rod for imparting a predetermined movement to the first and second members of each limb.

5. The automated mechanism of claim 4 wherein the rotation of the cam means and movement of the connecting rod impart to each limb an oscillational motion of the first and second members about their respective axes of rotation and translational motion of the axis of rotation of the second member.

6. The automated mechanism of claim 5 comprising a pair of limbs for forming a two-legged toy with free ends of the second limb members constituting feet and wherein the cam means and connecting rods impart a walking eliptical-orbit type movement to the two legs.

7. The automated mechanism of claim 5 comprising two pairs of limbs for forming a four-legged toy with free ends of the second limb members constituting feet and wherein the cam means and connecting rods impart a walking type movement to the four legs.

* * * * *